US005866310A

United States Patent [19]

Ishida

[11] Patent Number: 5,866,310

[45] Date of Patent: Feb. 2, 1999

[54] SOLID PHOTOGRAPHIC PROCESSING COMPOSITION FOR DEVELOPING A SILVER HALIDE PHOTOGRAPHIC LIGHT-SENSITIVE MATERIAL

[75] Inventor: Kenji Ishida, Hino, Japan

[73] Assignee: Konica Corporation, Japan

[21] Appl. No.: 730,570

[22] Filed: Oct. 15, 1996

Related U.S. Application Data

[63] Continuation of Ser. No. 429,316, Apr. 26, 1995, abandoned.

[30] Foreign Application Priority Data

Apr. 28, 1994 [JP] Japan ..... 6-091989

[51] Int. Cl.[6] ..... G03C 5/44

[52] U.S. Cl. ..... 430/461; 436/458; 436/465

[58] Field of Search ..... 430/458, 461, 430/465

[56] References Cited

U.S. PATENT DOCUMENTS

| | | | |
|---|---|---|---|
| 5,053,821 | 10/1991 | Kuhnert | 430/465 |
| 5,273,865 | 12/1993 | Loiacono et al. | 430/490 |
| 5,336,588 | 8/1994 | Ueda | 430/465 |
| 5,362,610 | 11/1994 | Yoshimoto | 430/465 |
| 5,376,509 | 12/1994 | Yoshimoto et al. | 430/465 |
| 5,409,805 | 4/1995 | Haraguchi et al. | 430/465 |
| 5,480,768 | 1/1996 | Ishida et al. | 430/458 |

FOREIGN PATENT DOCUMENTS

| | | | |
|---|---|---|---|
| 0537365 | 4/1993 | European Pat. Off. . | |
| 0563571 | 6/1993 | European Pat. Off. . | |
| 0569852 | 11/1993 | European Pat. Off. . | |
| 0611986 | 8/1994 | European Pat. Off. | 430/465 |

*Primary Examiner*—Richard L. Schilling

*Attorney, Agent, or Firm*—Jordan B. Bierman; Bierman, Muserlian and Lucas LLP

[57] ABSTRACT

Disclosed is a solid photographic processing composition for developing a silver halide photographic light-sensitive material comprising a ferric complex of an aminopolycarboxylic acid and a sugar alcohol compound.

8 Claims, No Drawings

SOLID PHOTOGRAPHIC PROCESSING COMPOSITION FOR DEVELOPING A SILVER HALIDE PHOTOGRAPHIC LIGHT-SENSITIVE MATERIAL

This application is a continuation of application Ser. No. 08/429,316, filed Apr. 26, 1995, now abandoned.

FIELD OF THE INVENTION

The present invention relates to a powder shaped, a granular shaped or a tablet shaped solid photographic processing composition for developing a silver halide photographic light-sensitive material.

BACKGROUND OF THE INVENTION

Silver halide light-sensitive color photographic materials are usually processed with a color developing solution, a bleaching solution, a bleach-fixing solution, a fixing solution, a stabilizing solution, etc., to obtain an image. The respective processing solutions are usually contained in a plastic bottle and supplied to customers in the form of a processing kit and the customer prepares a working solution, (i.e., a starting solution and a replenishing solution) and then use the processing solution.

However, the processing kits have still needed to have a lot of spaces for storing them, and the transportation cost of the kits can also in no way be slighted.

For saving the storage space, cutting down the transportation cost and reducing the quantity of waste plastic bottles, it may be considered to pulverize a photographic processing composition and then to supply it. However, a pulverized photographic processing composition has not only such a problem that there is an apprehension for the worker's health, because the fine powder thereof is whirled up in the air when dissolving the composition and he may possibly inhale the flying powder, but also such a problem that a whirling processing composition component is mixed in another photographic processing composition and thereby a trouble is produced in the development process.

On the other hand, Japanese Patent O.P.I. Publication No. 3-39739(1991) discloses granulated agent of aminopolycarboxylic acid ferric complex, comprising a re-halogenation agent and having a certain average grain diameter. According to this method, since this granulated agent is not apparently powder shaped, scattering of the agent may be restricted, however, it was found that this had a defect that there is large variation of quality in the manufactured product, apparently due to the difference of bonding strength between ferric complex and the re-halogenation agent.

Further, it was found that there is another defect that physical property of the granulated agent is changed, with the lapse of time, and, finaly, the agent loses function as granulated particle.

So quality variation in the manufactured product tends to take place when the granulated agent is molded by compression molding and hardness of the tabular shaped composition manufactured therefrom can be deteriorated. The diameter and thickness of the tabular shaped composition expands with the lapse of time, and then, it is found that the hardness of the tabular shaped composition is deteriorated. Needless to say, expansion of the tabular shaped composition leads to a deterioration of a market value, and deterioration of the hardness of the tabular shaped composition often causes cracking and partial loss by vibration or impact applied during transportation, so that they are serious problems as to a quality of the tabular shaped composition.

Further, Japanese Patent O.P.I. Publications No. 5-119454 (1993) and No. 6-19100(1994) disclose a tabular shaped processing composition comprising a ferric complex of aminopolycarboxylic acid and a re-halogenation agent.

Still further, Japanese Patent O.P.I. Publications No. 4-254853(1992) discloses a granular shaped composition comprising an aminopolycarboxylic acid ferric salt and polyethylene glycol.

According to this method, components of the granular shaped composition are stable, because polyethylene glycol functions as a binder, however, it was found that it is not sufficient to solve the variation of physical properties of the granular shaped composition. Furthermore, the granulated agent is compressed to prepare a tabular shaped composition, so that a hardness degradation of the tabular shaped composition with the lapse of time is avoided to some extent. However, it was found that cracks of the surface of the tabular shaped composition and expansion of the tabular shaped composition took place.

Still further, Japanese patent O.P.I. Publication No. 51-61837(1976) discloses a tabular shaped composition comprising a ferric complex of aminopolycarboxylic acid and lactose. In accordance to this method, again, although the binding force of the tabular shaped compositions may be enhanced to some extent, however, this method cannot solve the above-mentioned problems of storage under high temperature and low humidity conditions.

After long and intensive research on the solid photographic processing composition containing an aminopolycarboxylic acid ferric salt, when a sugar alcohol is contained in the solid photographic processing composition, the present inventors have discovered the following improved results. In a large-scale preparation, a content variation of the solid photographic processing composition is small, and the granulated properties is stable at the lapse of time, and, when the tabular shaped processing composition is prepared by compressing molding, expansion of the tabular shaped processing composition and hardness deterioration of the tabular shaped processing composition are not occurred.

SUMMARY OF THE INVENTION

The object of the present invention is to provide a solid photographic processing composition used for silver halide light-sensitive photographic materials, which has no variation in the ingredient as a bleaching agent and has improved bleaching ability with less problems in the physical properties after long period of storage under the conditions of a high temperature and a low humidity.

The above-mentioned object of the present invention is achieved by the following items.

Item 1: A solid photographic processing composition for processing a silver halide photographic light-sensitive material, which comprises a ferric complex of an aminopolycarboxylic acid and a sugar alcohol compound.

Item 2: The solid photographic processing composition of item 1, wherein said sugar alcohol is contained in an amount of from 0.5% to 30% by weight.

Item 3: The solid photographic processing composition of item 1, wherein said photographic processing composition comprises a ferric complex hydrate and a decreasing ratio in weight of said photographic processing composition after drying at 50° C. is within the range of 0.1% to 10.0% by weight.

Item 4: The solid photographic processing composition of item 2, wherein said photographic processing composition comprises a ferric complex hydrate and a decreasing ratio in weight of said photographic processing composition after drying at 50° C. is within the range of 0.1% to 10.0% by weight.

Item 5: The solid photographic processing composition of item 1, wherein said photographic processing composition is a granular shaped composition, and said granular shaped composition is prepared by applying compression by making use of a tableting machine.

Item 6: The solid photographic processing composition of item 2, wherein said photographic processing composition is a granular shaped composition, and said granular shaped composition is prepared by applying compression by making use of a tableting machine.

Item 7: The solid photographic processing composition of item 4, wherein said photographic processing composition is a granular shaped composition, and said granular shaped composition is prepared by applying compression by making use of a tableting machine.

Item 8: The solid photographic processing composition of item 1, wherein said aminopolycarboxylic acid is represented by Formula I:

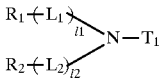

Formula I wherein $T_1$ represents a hydrogen atom, a hydroxyl group, a carboxyl group, a sulfo group, a carbamoyl group, a phosphono group, a phosphonic group, a sulfamoyl group, an alkyl group, an alkoxyl group, an alkylsulfonamido group, an alkylthio group, an acylamino group, a hydroxamic acid, a hydroxyalkyl group or

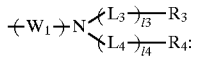

wherein $W_1$ represents an alkylene group, an arylene group, an alkenylene group, a cycloalkylene group, an aralkylene group or

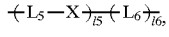

wherein X represents —O—, —S—, a divalent heterocyclic group or

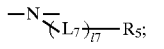

wherein $R_1$ through $R_5$ independently represent a hydrogen atom, a hydroxyl group, a carboxyl group, a sulfo group, a carbamoyl group, a phosphono group, a phosphonic group, a sulfamoyl group, a sulfonamido group, an acylamino group or a hydroxamic group, provided that at least one of $R_1$ through $R_5$ is a carboxyl group; $L_1$ through $L_7$ independently represent a group selected from the group consisting of an alkylene group, an arylene group, an alkenylene group, a cycloalkylene group and an aralkylene group; $l_1$ trough $l_7$ independently represent an integer of zero to six, provided that $l_5$ through $l_6$ are not zero simultaneously.

Hereinbelow the present invention is explained in detail:

The present inventors have carried out extensive amount of research and experiments and have found the following facts:

It is known in the art that an aminopolycarboxylic acid ferric complex compound, which may be herein below abbreviated as APC-Fe, is used in the solid photographic processing composition, however, what was made clear by the present invention is that APC-Fe has shows low bonding strength, and when a granular shaped processing composition is manufactured, proportion of fine powder becomes larger, and it is easily blown off into the air, which causes an operational problem and, when a tabular shaped processing composition is manufactured, predetermined hardness of the tabular shaped processing composition can hardly be obtained and, moreover, there has been a problem that the tabular shaped composition is easily broken by vibration or impact during transportation.

In order to enhance the bonding strength of the ACP-Fe, the present inventors have tried to decrease weight ratio of the ACP-Fe. However, it was found that the bonding strength of the APC-Fe is not affected by the weight ratio in the presence of APC-Fe and the similar problem causes. Moreover, the reduction of weight ratio of APC-Fe leads to remarkable increase of volume of the processing composition, so that it cannot be an effective countermeasure to decrease weight ratio of the ACP-Fe.

Further the present inventors have tried to add some other known water-soluble polymers for the purpose of enhancing the bonding strength of APC-Fe.

By the use of lactose and a water-soluble polymer such as polyethylene glycol, etc. it is possible to improve the bonding strength, and a granular shaped composition or a tabular shaped composition having preferable bonding strength may be obtained, however, when granular shaped composition or tabular shaped composition manufactured by this method are stored under high temperature and low humidity conditions, it was found that the bonding strength of the granular shaped composition was rapidly decreased after storing, causing large amount of fine powder.

Further, deterioration of fluidity of the granular shaped composition causes a problem that operational performance at the time of dissolution is jeopardized.

When the tabular shaped compositions are stored, expansion in the diameter direction and in the thickness direction took place, and the tabular shaped composition hardness is deteriorated and the commercial value of the tabular shaped composition is also deteriorated.

Solid photographic processing composition for the silver halide light-sensitive photographic material are generally filled up in a sealed container, so that humidity condition inside the container is low. And, thus, the above-mentioned problem which takes place in the low humidity condition was serious.

Additionally, the solid photographic processing composition of the present invention may be stored in high temperature area like as Southeast Asia region or the solid composition may be bathed in direct sunlight, and therefore, there is so serious problem in practical use under high temperature condition mentioned above.

After carrying out further research based on the above-mentioned knowledge, the inventors of the present invention have found that a granular shaped composition, with which generation of fine powder, when it is stored under low humidity condition and a tabular shaped composition, of which expansion and lowering of hardness, are minimized, can be provided by incorporating a sugar alcohol compound into a solid photographic processing composition for silver halide light-sensitive photographic material comprising a ferric complex of an aminopolycarboxylic acid and having a bleaching ability.

It was a surprising and unexpected for the inventors of the present invention to find a fact that only additive selected from sugar alcohol compound can make up the loss of the bonding strength of APC-Fe, and this fact was found after huge amount of research and experiment by the inventors of the present invention.

The solid photographic photographic processing composition for silver halide light-sensitive photographic material of the present invention is in the form of fine powder shaped composition, a granular shaped composition or a tabular shaped composition.

Preferably, it is in the form of granular shaped compositions or tabular shaped compositions. In view of expansion or degradation of hardness, which are the main effects of the present invention, it is, most preferably, in the form of a tabular shaped composition.

The term "powder" of the present invention shows aggregation of fine powder crystals, and "granular shaped composition" means coarse particles made from the powder and having 50 to 5000 μm in size; more preferably, 100–2000 μm, and most preferably, 200 to 1500 μm in size.

As for the method of granulation, any conventional methods can be employed, including a fluidized bed granulation method, an extrusion granulation method, a compression granulation method, a pulverization method, stirring granulation method, a fluidity layer granulation method, a spray-dry granulation method, etc.

The term "tabular shaped composition" used in the present invention means one which is molded by compression into a predetermined shape from powder or granular shaped composition. For the effects of the present invention to be exerted most distinguishably, at least a part of the raw materials be granulated and, more preferably, all of the raw materials are granular shaped.

Moreover, the solid photographic processing composition of the present invention can be manufactured with the use of any conventional compressor known in the art, including, for example, a hydraulic compressor, a single-engined molding machine, a rotary tabular shaped composition making machine, a prequetting machine, etc. can be employed.

The tabular shaped solid photographic processing composition may be optional, however, in view of productivity and easy handling, a cylindrical shaped composition is preferable.

The solid photographic processing composition for silver halide light-sensitive photographic material of the present invention comprises at least one kind of ferric complex of aminopolycarboxylic acid and it may comprise two or more kinds different ferric complexes of aminopolycarboxylic acid in combination.

As for the ferric complex of the aminopolycarboxylic acid, it is preferable that the compound is used in the form of a ferric complex of a free acid represented by the following formula [I] given below and it is more preferable to use the above-mentioned ferric complex and the free acid of aminopolycarboxylic acid in combination. Particularly preferable combination is a free acid of an aminopolycarboxylic acid and a ferric complex of the same free acid.

The above mentioned ferric complex of aminopolycarboxylic acid can be used in the form of a potassium salt, a sodium salt, an ammonium salt, etc. and the free acid of the aminopolycarboxylic acid may be in the form of a free acid, potassium salt, sodium salt, etc.

As for specific examples of the above-mentioned aminopolycarboxylic acid, compounds represented by the following formula [I] can be mentioned:

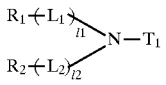

Formula [I]

wherein $T_1$ represents a hydrogen atom or a group selected from the group consisting of a hydroxyl group, a carboxyl group, a sulfo group, a carbamoyl group, a phosphono group, a phosphonic group, a sulfamoyl group, an alkyl group, an alkoxy group, an alkylsulfonamide group, an alkylthio group, an acylamino group, a hydroxamic acid, a hydroxyalkyl group and the group represented as follows;

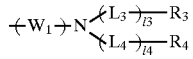

in which $W_1$ represents an alkylene group, an arylene group, an alkenylene group, a cycloalkylene group, or an aralkylene group or a group represented by

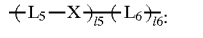

X represents —O—, —S—, a divalent heterocycle or

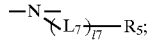

$R_1$ through $R_5$ independently represent a hydrogen atom or a group selected from the group consisting of a hydroxyl group, a carboxyl group, a sulfo group, a carbamoyl group, a phosphono group, a phosphonic group, a sulfamoyl group, a sulfonamide group, an acylamino group and a hydroxamic group, provided that at least one of $R_1$ through $R_5$ is a carboxyl group;

$L_1$ through $L_7$ independently represent a group selected from the group consisting of a substituted or unsubstituted alkylene group, an arylene group, an alkenylene group, a cycloalkylene group and an aralkylene group; $l_1$ trough $l_7$ independently represent an integer of zero to six, provided that $l_5$ through $l_6$ are not zero simultaneously.

Specific examples of the ferric complex of aminopolycarboxylic acid hydrides represented by the general formula [I] are shown below:

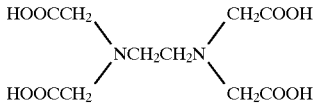

I-1

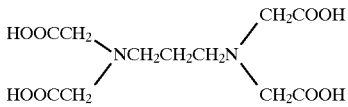

I-2

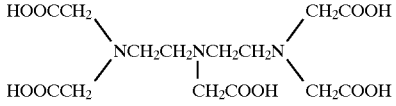

I-3

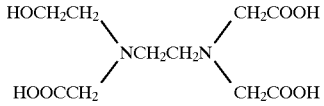

I-4

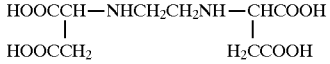

I-5

-continued

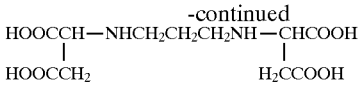
I-6

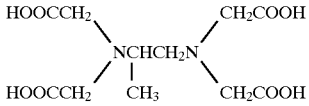
I-7

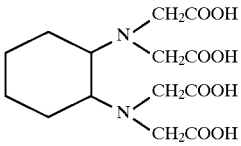
I-8

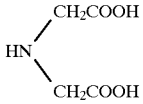
I-9

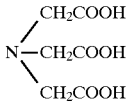
I-10

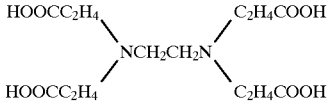
I-11

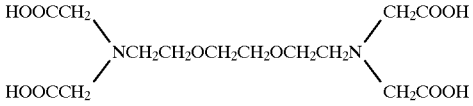
I-12

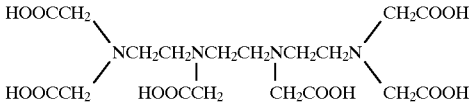
I-13

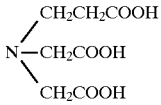
I-14

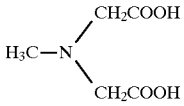
I-15

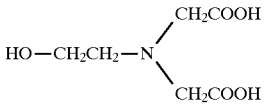
I-16

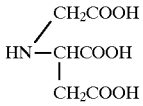
I-17

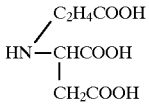
I-18

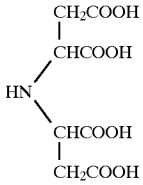
I-19

-continued

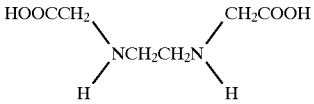
I-20

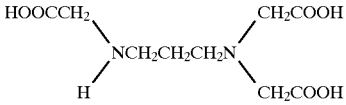
I-21

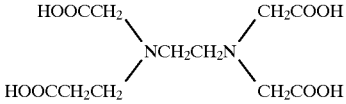
I-22

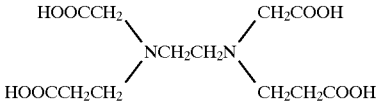
I-23

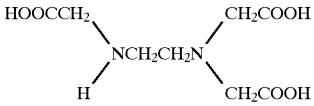
I-24

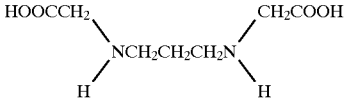
I-25

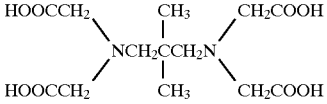
I-26

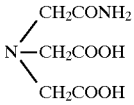
I-27

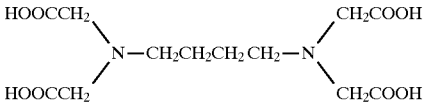
I-28

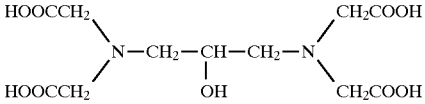
I-29

Among these, (I-1) through (I-8), (I-12), (I-14) through (I-20), (I-22), (I-23) and(I-27) can be mentioned as preferable compounds.

As especially preferable compounds, (I-1), (I-2), (I-6), (I-12), (I-14), (I-15) and (I-17) can be mentioned.

Specific examples of the ferric complex hydrates of aminopolycarboxylic acid are given below:

| Fe(III) Complex of Aminopolycarboxylic Acid | | | Preferable Amount of Water of Crystallization in Fe(III) Complex of Aminopolycarboxylic Acid |
|---|---|---|---|
| No. | Amino-polycarboxylic Acid | Counter Cation | Mol number of water of crystallization per a mol of Iron |
| II-1 | I-1 | $Na^+$ | 3 |
| II-2 | I-1 | $K^+$ | 2 |

-continued

| Fe(III) Complex of Aminopolycarboxylic Acid | | | Preferable Amount of Water of Crystallization in Fe(III) Complex of Aminopolycarboxylic Acid |
|---|---|---|---|
| No. | Amino-polycarboxylic Acid | Counter Cation | Mol number of water of crystallization per a mol of Iron |
| II-3 | I-1 | $NH_4^+$ | 2 |
| II-4 | I-2 | $Na^+$ | 3 |
| II-5 | I-2 | $K^+$ | 1 |
| II-6 | I-2 | $NH_4^+$ | 1 |
| II-7 | I-3 | $K^+$, $H^+$ | 1 |
| II-8 | I-3 | $NH_4^+$, $H^+$ | 1 |
| II-9 | I-5 | $K^+$ | 1 |
| II-10 | I-5 | $NH_4^+$ | 1 |
| II-11 | I-14 | — | 2 |
| II-12 | I-28 | $K^+$ | 1 |
| II-13 | I-26 | $K^+$ | 1 |
| II-14 | I-10 | — | 1.5 |
| II-15 | I-8 | $NH_4^+$ | 2 |

The solid photographic processing composition for silver halide light-sensitive photographic materials of the present invention comprises at least one kind of sugar alcohol, and different kinds of sugar alcohols may be used in combination.

The term 'sugar alcohol' of the present invention is a general term for polyalcohols corresponding to a primary or a secondary alcohol produced by reducing aldehyde group or ketone group of the sugar.

Specific examples of sugar alcohols used in the present invention are given below:

(III-1) Glycerine
(III-2) D-Thereitol
(III-3) L-Threitol
(III-4) Erythritol
(III-5) D-Arabitol
(III-6) L-Arabitol
(III-7) Adonitol
(III-8) Xylitol
(III-9) D-Sorbitol
(III-10) L-Sorbitol
(III-11) D-Mannitol
(III-12) L-Mannitol
(III-13) D-Iditol
(III-14) L-Iditol
(III-15) D-Talitol
(III-16) L-Talitol
(III-17 Dulcitol
(III-18) Allodulcitol Among these exemplified compounds, preferable ones are (III-4), (III-9) through (III-18) and especially preferable compounds are (III-4), (III-9) and (III-11).

In the present invention, the sugar alcohol used in the solid photographic processing composition for silver halide light-sensitive photographic material is preferable employed in an amount of not less than 0.5 wt %, and is more preferably employed in an amount of not less than 1.0 wt %. Furthermore, the sugar alcohol used in the solid photographic processing composition for silver halide light-sensitive photographic material is preferable employed in an amount of not more than 30 wt %, and is more preferably employed in an amount of not more than 20 wt %.

In the present invention, a decreasing ratio in weight of a photographic processing composition after drying at 50° C. is defined as follows.

About 10 g of a photographic processing composition is dried in a commercially available electronic moisture meter at 50° C. for 10 minutes, and then, a decreasing weight is measured under the conditions, that is, an atmospheric pressure, a temperature condition of from 25° to 30° C. and a relative humidity of from 40 to 45%. The decreasing weight is defined as a decreasing ratio in weight of a photographic composition.

The solid photographic processing composition of the present invention is applied to solid photographic processing composition for bleaching use or bleach-fixing, and further, the solid photographic processing composition is applied to all other solid photographic composition which comprises a ferric complex of aminopolycarboxylic acid.

EXAMPLE

Hereinbelow the present invention is further explained with reference to working examples:

Example 1

(Procedure: 1-1)

Ferric complex of the Exemplified Compound (as shown in Table 1) 1900 g

Free acid of the above-exemplified compound 100 g

Potassium bromide 900 g

Succinic acid 700 g

Disodium mleate monohydrate 300 g

Adipic acid 200 g

Additive-1 as shown in Table 1 as shown in Table 1

After respective raw materials mentioned above were pulverized into fine grains having average grain diameter of not more than 50 μm with a hammer-mill, they were granulated in a mixing granulator while mixing and spraying water.

Amount of water used in this step was 100 ml. These granulated products were dried at 60° C. for four hours using a commercially available fluidized-bed dryer. This is called granulated product (a).

(Procedure: 1-2)

To the granulated product (a), 2% by weight of sodium lauroylsarcosine was added and after mixing this for three minutes, tabular shaped processing composition for bleaching, having diameter of 30 mm, and 11 g in weight a tabular shaped composition was prepared by the use of a tablet molding machine obtained by modifying Clean Press Collect 18K, a product of Kikusui Manufacturing Co., Ltd.

Thus prepared tabular shaped compositions were sealed up in a packaging bag, which is made of aluminium, and stored for two weeks under atomospheric conditions of 30% R.H. and 50° C.

After storage, increased amount of diameter and thickness of the tabular shaped composition were measured, to obtain the rate of expansion.

Further, by the use of s Speed Checker, a product of Okada Manufacturing Company Ltd., destructive strength (hardness) with respect to he direction towards diameter was measured.

Results thus obtained are shown in Table 1.

TABLE 1

| Sample No. | Exemplified Compound | Additive-1 (wt %) | Rate of Expansion after Storage Diameter (%) | Rate of Expansion after Storage Thickness (%) | Hardness after Storage | Remarks |
|---|---|---|---|---|---|---|
| 1-1 | II-6 | — | 6.2 | 8.3 | 8.0 | Comp. |
| 1-2 | II-6 | D-Mannitol (0.3) | 3.6 | 4.2 | 21.0 | Inv. |
| 1-3 | II-6 | D-Mannitol (0.5) | 1.7 | 2.3 | 32.0 | Inv. |
| 1-4 | II-6 | D-Mannitol (1.0) | 1.2 | 1.8 | 40.0 | Inv. |
| 1-5 | II-6 | D-Mannitol (5.0) | 1.3 | 1.9 | 43.0 | Inv. |
| 1-6 | II-6 | D-Mannitol (10.0) | 1.3 | 1.7 | 46.0 | Inv. |
| 1-7 | II-6 | D-Mannitol (20.0) | 1.5 | 1.7 | 45.0 | Inv. |
| 1-8 | II-6 | D-Mannitol (30.0) | 2.1 | 2.5 | 46.0 | Inv. |
| 1-9 | II-6 | D-Mannitol (35.0) | 3.9 | 3.8 | 49.0 | Inv. |
| 1-10 | II-6 | D-Sorbitol (0.5) | 1.6 | 1.9 | 42.0 | Inv. |
| 1-11 | II-6 | D-Sorbitol (5.0) | 1.2 | 1.8 | 53.0 | Inv. |
| 1-12 | II-6 | D-Sorbitol (10.0) | 1.1 | 1.8 | 55.0 | Inv. |
| 1-13 | II-6 | Erythritol (5.0) | 1.3 | 1.7 | 40.0 | Inv. |
| 1-14 | II-6 | Glycerine (5.0) | 2.2 | 2.8 | 28.0 | Inv. |
| 1-15 | II-6 | Adnit (5.0) | 2.0 | 2.6 | 27.0 | Inv. |
| 1-16 | II-6 | PEG600 (5.0) | 8.3 | 9.9 | 19.0 | Comp. |
| 1-17 | II-6 | PEG2000 (5.0) | 8.1 | 9.6 | 25.0 | Comp. |
| 1-18 | II-6 | PEG6000 (5.0) | 6.0 | 7.9 | 26.0 | Comp. |
| 1-19 | II-6 | Lactose (5.0) | 5.7 | 6.1 | 14.0 | Comp. |
| 1-20 | II-6 | HPC (5.0) | 6.3 | 7.0 | 13.0 | Comp. |
| 1-21 | II-1 | — | 6.9 | 9.0 | 5.0 | Comp. |
| 1-22 | II-3 | — | 6.1 | 7.9 | 10.0 | Comp. |
| 1-23 | II-8 | — | 7.3 | 8.9 | 8.0 | Comp. |
| 1-24 | II-9 | — | 7.1 | 8.5 | 6.0 | Comp. |
| 1-25 | II-1 | D-Mannitol (5.0) | 1.5 | 1.8 | 40.0 | Inv. |
| 1-26 | II-3 | D-Mannitol (5.0) | 1.3 | 1.7 | 43.0 | Inv. |
| 1-27 | II-8 | D-Mannitol (5.0) | 1.4 | 1.9 | 40.0 | Inv. |
| 1-28 | II-9 | D-Mannitol (5.0) | 1.4 | 2.1 | 39.0 | Inv. |
| 1-29 | II-6 | D-Mannitol (4.0) D-Sorbitol (2.0) | 1.0 | 1.2 | 59.0 | Inv. |

Comp.: Comparison
Inv.: Invention
Note)
PEG = Polyethylene Glycol (The numerical value means average molecular weight)
HPC = Hydroxypropyl Cellullose As is obvious from Table-1, it is understood that the samples of the present invention, which comprise both a ferric complex of aminopolycarboxylic acid and a sugar alcohol can exhibit reduced rate of expansion and decrease in the hardness of the tabular shaped composition the tabular shaped composition after storage under atomospheric conditions of high temperature and low humidity in comparison with comparative samples.

It is also understood that preferable content of sugar alcohol is not less than 0.5 wt % and, more preferably, not less than 1.0 wt % and not more than 30 wt % and, more preferably, not more than 20 wt %.

Example 2

In Example 1, respective granulated products (grains), which were prepared according to (Procedure: 1-1), were passed through a sieve with the mesh size of 149 μm and 100 g of respective grains having grain size of not less than 149 μm were sealed up in the packaging bag made of aluminium, and stored for two weeks under the same atomospheric conditions (RH30%, 50° C.) as in Example 1.

After storage, respective granular products were subjected to vibration test (5–67 Hz/210 sec for 30 mins.) by the use of a Vibration Tester BF-UA, a product of IDEX Company.

After completion of the vibration test, occurrence of fine powder with respect to the respective granular products were evaluated by use of sieve having a mesh of 100 μm.

Evaluation was carried out based upon the following standards:

| Grade | Rate of Occurrence of Fine Powder |
|---|---|
| E: Excellent | 0–10% |
| G: Good | 10–20% |
| F: Fair | 20–30% |
| P: Poor | 30–50% |
| B: Bad | 50–70% |
| VB: Very Bad | 70–100% |

$$\left(\text{Rate Of Occurrence of Fine Powder (\%)} = \frac{\text{Amount of powder of less than 100 } \mu\text{m (g)}}{\text{Grain 100 (g)}} \times 100\right)$$

TABLE 2

| Sample No. | Exemplified Compound | Additive-1 (Amount in wt %) | Rate of Occurrence of Fine Powder | Remarks |
|---|---|---|---|---|
| 2-1 | II-6 | — | Bad | Comparison |
| 2-2 | II-6 | D-Mannit (5.0) | Excellent | Invention |
| 2-3 | II-6 | D-Sorbitol (5.0) | Excellent | Invention |
| 2-4 | II-6 | Erythritol (5.0) | Excellent | Invention |
| 2-5 | II-6 | D-Arabitol (5.0) | Good | Invention |
| 2-6 | II-6 | Glycerine (5.0) | Fair | Invention |
| 2-7 | II-6 | D-Iditol (5.0) | Excellent | Invention |
| 2-8 | II-6 | Dulcitol (5.0) | Excellent | Invention |
| 2-9 | II-6 | D-Threitol (5.0) | Good | Invention |
| 2-10 | II-6 | PEG600 | Bad | Comparison |

TABLE 2-continued

| Sample No. | Exemplified Compound | Additive-1 (Amount in wt %) | Rate of Occurrence of Fine Powder | Remarks |
|---|---|---|---|---|
| 2-11 | II-6 | PEG2000 | Bad | Comparison |
| 2-12 | II-6 | PEG6000 | Bad | Comparison |
| 2-13 | II-6 | Lactose | Bad | Comparison |
| 2-14 | II-6 | HPC | Bad | Comparison |
| 2-15 | II-1 | D-Mannitol | Excellent | Invention |
| 2-16 | II-3 | D-Mannitol | Excellent | Invention |
| 2-17 | II-8 | D-Mannitol | Excellent | Invention |
| 2-18 | II-9 | D-Mannitol | Excellent | Invention |

It is obvious from Table 2 that the granular agents prepared according to the present invention can minimize, in comparison with comparative samples, occurrence of fine powder after storage under high temperature and low humidity conditions by incorporating the sugar alcohol of the invention in the grain.

Example 3

In this Example, tabular shaped compositions were prepared and the experiments were carried out in the same manner as in Example 1, except that a tabular shaped composition form processing agent for bleaching had a diameter of 15 mm and weight of 1.7 g a tabular shaped composition in procedure (1-2) of Example 1. Similar results as Example 1 were obtained. Thus it was found that the effect of the present invention can be obtained independent of the diameter of the tabular shaped composition.

Example 4

(Procedure: 4-1)

Ferric complex of the exemplified compound (as shown in Table 3) 720 g

Free acid of the above-mentioned exemplified compound 70 g

Additive-1 (as shown in Table 3) as shown in Table 3

Sodium carbonate monohydrate 70 g

After respective raw materials mentioned above were pulverized into fine grains having average grain diameter of not more than 50 μm with a hammer-mill, they were granulated in a mixing granulator while mixing and spraying water.

Amount of water used in this step was 50 ml. These granulated products were dried for three hours using a conventional fluidized-bed dryer at 60° C. This is called granulated product (b).

(Procedure: 4-2)

Ammonium thiosulfite 800 g

Sodium sulfate 160 g

Sodium metasulfate 60 g

Additive-2 (as shown in Table 3) See Table 3

After respective raw materials mentioned above were pulverized into fine grains having average grain diameter of not more than 50 μm with a hammer-mill, they were granulated in a mixing granulator while mixing and spraying water.

Amount of water used in this step was 50 ml. These granulated products were dried for three hours using a conventional fluidized-bed dryer at 60° C. This is called granulated product (c).

To the granulated products (b) and (c), 0.5% by weight of sodium lauroylsarcosine was added and after mixing this for three minutes, tabular shaped processing composition for bleaching, having diameter of 30 mm and 10 g in weight a was prepared.

Thus prepared tabular shaped compositions were sealed up in a packaging bag, which is made of aluminium and the same experiment as Example 1 was carried out.

Results obtained are shown in Table 3:

TABLE 3

| Sample No. | Exemplified Compound | Additive-1 (wt %) | Additive-2 (wt %) | Expansion Rate after Storage: Diameter (%) | Expansion Rate after Storage: Thickness (%) | Hardness after Storage (kg) | Remarks |
|---|---|---|---|---|---|---|---|
| 3-1 | II-1 | — | — | 5.8 | 7.7 | 12.0 | Comparison |
| 3-2 | II-1 | D-Mannit (1.0) | — | 1.1 | 1.4 | 48.0 | Invention |
| 3-3 | II-1 | D-Mannit (5.0) | — | 0.8 | 1.2 | 55.0 | Invention |
| 3-4 | II-1 | D-Mannit (20.0) | — | 1.5 | 1.6 | 53.0 | Invention |
| 3-5 | II-1 | D-Mannit (30.0) | — | 1.9 | 2.2 | 55.0 | Invention |
| 3-6 | II-1 | D-Mannit (40.0) | — | 2.9 | 3.2 | 54.0 | Invention |
| 3-7 | II-1 | — | D-Mannit (5.0) | 2.0 | 2.8 | 47.0 | Invention |
| 3-8 | II-1 | D-Sorbit (5.0) | — | 1.0 | 1.2 | 62.0 | Invention |
| 3-9 | II-1 | Erythrit (5.0) | — | 1.3 | 1.5 | 49.0 | Invention |
| 3-10 | II-1 | Glycerine (5.0) | — | 1.9 | 2.3 | 37.0 | Invention |
| 3-11 | II-1 | D-Mannit (5.0) | PEG2000 (5.0) | 1.0 | 1.3 | 56.0 | Invention |
| 3-12 | II-1 | PEG6000 (5.0) | PEG6000 (5.0) | 4.9 | 6.8 | 49.0 | Comparison |
| 3-13 | II-1 | PEG2000 (5.0) | PEG2000 (5.0) | 5.9 | 8.0 | 38.0 | Comparison |
| 3-14 | II-1 | Lactose (5.0) | Lactose (5.0) | 5.5 | 7.2 | 19.0 | Comparison |
| 3-15 | II-1 | HPC (5.0) | HPC (5.0) | 5.1 | 7.4 | 27.0 | Comparison |
| 3-16 | II-8 | D-Mannit (5.0) | — | 0.9 | 1.4 | 56.0 | Invention |
| 3-17 | II-3 | D-Mannit (5.0) | — | 0.9 | 1.3 | 54.0 | Invention |
| 3-18 | II-6 | D-Mannit (5.0) | — | 1.2 | 1.4 | 49.0 | Invention |
| 3-19 | II-10 | D-Mannit (5.0) | — | 1.1 | 1.6 | 50.0 | Invention |
| 3-20 | II-14 | D-Mannit (5.0) | — | 1.0 | 1.5 | 52.0 | Invention |
| 3-21 | II-8 | — | — | 5.9 | 7.5 | 13.0 | Comparison |
| 3-22 | II-3 | — | — | 5.7 | 7.2 | 11.0 | Comparison |
| 3-23 | II-6 | — | — | 6.7 | 8.9 | 9.0 | Comparison |
| 3-24 | II-10 | — | — | 5.9 | 7.9 | 12.0 | Comparison |
| 3-25 | II-14 | — | — | 5.5 | 7.5 | 10.0 | Comparison |

It is obvious from Table 3 that according to the present invention, similar effects can be obtained with respect to a tabular shaped composition bleach-fixing agent, and from results of Samples No. 3-3 and No. 3-7 that in the case of a tabular shaped composition made from a mixture of two or more kinds of granulated products, the effects of the present invention may be obtained by incorporating in the tabular shaped composition comprising a ferric complex of aminopolycarboxylic acid at least one sugar alcohol and, more preferably in the tabular shaped composition comprising APC-Fe the sugar alcohol of the present invention.

Example 5

Experiments were repeated in the same manner as Example 4, except that in this example, Exemplified Compounds II-1, II-3, II-7, II-9, II-10 and II-14 were used, and similar effects of the present invention as obtained in Example 4 were observed.

Example 6

Mixed granular products prepared by mixing Granular products (b) and (c) prepared in Example 4, were passed through a sieve with the mesh size of 149 μm and 100 g of respective grains having grain size of not less than 149 μm were sealed up in the packaging bag made of aluminium, and the same experiment as Example 2 was carried out.

Results are shown in Table 4.

TABLE 4

| Sample No. | Exemplified Compound | Additive-2 (wt %) | Additive-3 (wt %) | Rate of Occurrence of Fine Powder | Remarks |
|---|---|---|---|---|---|
| 4-1 | II-1 | — | — | Very Bad | Comparison |
| 4-2 | II-1 | D-Mannit (5.0) | — | Good | Invention |
| 4-3 | II-1 | D-Sorbit (5.0) | — | Good | Invention |
| 4-4 | II-1 | Erythrit (5.0) | — | Good | Invention |
| 4-5 | II-1 | D-Arabit (5.0) | — | Fair | Invention |
| 4-6 | II-1 | Glycerine (5.0) | — | Fair | Invention |
| 4-7 | II-1 | D-Idit (5.0) | — | Good | Invention |
| 4-8 | II-1 | Dulcit (5.0) | — | Good | Invention |
| 4-9 | II-1 | D-Threit (5.0) | — | Fair | Invention |
| 4-10 | II-1 | PEG600 (5.0) | — | Bad | Comparison |
| 4-11 | II-1 | PEG6000 (5.0) | — | Very Bad | Comparison |
| 4-12 | II-1 | Lactose (5.0) | — | Very Bad | Comparison |
| 4-13 | II-1 | HPC (5.0) | — | Very Bad | Comparison |
| 4-14 | II-1 | D-Mannit (5.0) | D-Mannit (5.0) | Excellent | Invention |
| 4-15 | II-1 | PEG600 (5.0) | PEG600 (5.0) | Bad | Comparison |
| 4-16 | II-8 | D-Mannit (5.0) | — | Good | Invention |
| 4-17 | II-3 | D-Mannit (5.0) | — | Good | Invention |
| 4-18 | II-6 | D-Mannit (5.0) | — | Fair | Invention |
| 4-19 | II-10 | D-Mannit (5.0) | — | Good | Invention |
| 4-20 | II-14 | D-Mannit (5.0) | — | Good | Invention |

It is obvious from Table 4 that the similar effects of the present invention can be obtained in the granular agent for bleach-fixing.

Example 7

To the granulated product (b) prepared in Example 4, 0.5% by weight of sodium lauroylsarcosine was added and after mixing this for three minutes, tabular shaped processing composition for bleach-fixing, having diameter of 30 mm and 10 g in weight a tabular shaped composition was prepared in the same manner as Example 1.

Thus prepared tabular shaped compositions were sealed up in a packaging bag, and the same experiments as in Example 4 were carried out.

As a result, it was understood that the similar results were obtained and that the effects of the present invention is obtainable with respect to a tabular shaped processing composition for bleach-fixing.

Example 8

Granulated product (b) prepared in Example 4 were passed through a sieve with the mesh size of 149 μm and 100 g of respective grains having grain size of not less than 149 μm were sealed up in the packaging bag made of aluminium and the same experiments as Example 2 were carried out.

As a result, it was understood that the similar results as those obtained in Example 6 were obtained, and, thus, the effects of the present invention is obtainable with respect to a tabular shaped processing composition for bleach-fixing.

Example 9

Granulated products as shown in Table 5, provided that in this example amount of water, drying temperature and drying time were varied, to prepare granulated products as shown in Table 5.

After mixing these granulated products with granulated product (c) in the same manner as in Example 4, tabular shaped processing composition for bleach-fixing, having diameter of 30 mm. and 10 g in weight a tabular shaped composition was prepared in the same manner as Example 4. Then thus prepared tabular shaped compositions were sealed up in a packaging bag, and the same experiments as in Example 4 were carried out.

Results are shown in Table 5.

TABLE 5

| Sample No. | Exemplified Compound | *1 Counter Cathion | Molar Number of Water | Amount of Reduced Weight by Drying at 50° C. | Additive-2 (wt %) | Additive-3 (wt %) | Rate of Expansion after Storage Diameter (%) | Rate of Expansion after Storage Thickness (%) | Hardness after Storage (kg) | Remarks |
|---|---|---|---|---|---|---|---|---|---|---|
| 5-1 | II-3 | $NH_4^+$ | 2 | 0.06 | Mannit (5.0) | PEG6000 (5.0) | 1.1 | 1.7 | 24 | Inv. |
| 5-2 | II-3 | $NH_4^+$ | 2 | 0.12 | Mannit (5.0) | PEG6000 (5.0) | 1.3 | 1.6 | 33 | Inv. |
| 5-3 | II-3 | $NH_4^+$ | 2 | 0.53 | Mannit (5.0) | PEG6000 (5.0) | 1.3 | 1.8 | 35 | Inv. |
| 5-4 | II-3 | $NH_4^+$ | 2 | 1.08 | Mannit (5.0) | PEG6000 (5.0) | 1.3 | 1.6 | 48 | Inv. |
| 5-5 | II-3 | $NH_4^+$ | 2 | 5.82 | Mannit (5.0) | PEG6000 (5.0) | 1.4 | 1.8 | 43 | Inv. |
| 5-6 | II-3 | $NH_4^+$ | 2 | 7.91 | Mannit (5.0) | PEG6000 (5.0) | 2.0 | 2.3 | 31 | Inv. |
| 5-7 | II-3 | $NH_4^+$ | 2 | 9.83 | Mannit (5.0) | PEG6000 (5.0) | 2.1 | 2.6 | 29 | Inv. |
| 5-8 | II-3 | $NH_4^+$ | 2 | 12.11 | Mannit (5.0) | PEG6000 (5.0) | 3.6 | 4.1 | 22 | Inv. |
| 5-9 | II-3 | $NH_4^+$ | 0 | 0.09 | Mannit (5.0) | PEG6000 (5.0) | 1.1 | 1.8 | 21 | Inv. |
| 5-10 | II-3 | $NH_4^+$ | 0 | 5.73 | Mannit (5.0) | PEG6000 (5.0) | 1.5 | 1.9 | 24 | Inv. |
| 5-11 | II-3 | $NH_4^+$ | 0 | 12.01 | Mannit (5.0) | PEG6000 (5.0) | 3.8 | 4.3 | 20 | Inv. |
| 5-12 | II-10 | $NH_4^+$ | 2 | 0.07 | Mannit (5.0) | PEG6000 (5.0) | 1.2 | 1.5 | 28 | Inv. |
| 5-13 | II-10 | $NH_4^+$ | 2 | 5.63 | Mannit (5.0) | PEG6000 (5.0) | 1.3 | 1.6 | 44 | Inv. |
| 5-14 | II-10 | $NH_4^+$ | 2 | 11.89 | Mannit (5.0) | PEG6000 (5.0) | 3.7 | 3.9 | 26 | Inv. |

Inv.: Invention
*Counter-Cation in the exemplified compound

As is obvious from Table 5, it is understood that the effects of the present invention become distinguished in the case where the tabular shaped composition comprises a ferric complex of aminopolycarboxylic acid hydrate and a decreasing ratio in weight of said photographic processing composition after drying at 50° C. is within the range of 0.1% to 10.0% by weight.

Example 10

Granular products as shown in Table 6, provided that in this example amount of water, drying temperature and drying time were varied, to prepare granular products as shown in Table 6.

Tabular shaped processing composition for bleach-fixing agent, having diameter of 30 mm and 10 g in weight a tabular shaped composition was prepared in the same manner as Example 1.

Then thus prepared tabular shaped compositions were sealed up in a packaging bag, and the same experiments as in Example 4 were carried out.

Results are shown in Table 6.

As is obvious from Table 6, as in the case of Example 9, it is understood that the effects of the present invention become distinguished in the case where the tabular shaped composition comprises a ferric complex of aminopolycarboxylic acid hydrate and the amount of reduced weight by drying at 50° C. is between 0.1 and 10.0% by weight.

Example 11

Respective granulated products (b) prepared in Example 10 were passed through a sieve with the mesh size of 149 $\mu$m and 100 g of respective grains having grain size of not less than 149 $\mu$m were sealed up in the packaging bag made of aluminium, and the same experiments as Example 2 were carried out.

Results are shown in Table 7.

TABLE 6

| Sample No. | Exemplified Compound | Counter Cathion | Molar Number of Water | Amount of Reduced Weight by Drying at 50° C. | Additive-1 (wt %) | Rate of Expansion after Storage Diameter (%) | Rate of Expansion after Storage Thickness (%) | Hardness after Storage (kg) | Remarks |
|---|---|---|---|---|---|---|---|---|---|
| 6-1 | II-6 | $NH_4^+$ | 1 | 0.05 | Mannit (5.0) | 1.3 | 1.7 | 20 | Invention |
| 6-2 | II-6 | $NH_4^+$ | 1 | 3.20 | Mannit (5.0) | 1.3 | 1.8 | 46 | Invention |
| 6-3 | II-6 | $NH_4^+$ | 1 | 9.62 | Mannit (5.0) | 1.5 | 1.9 | 37 | Invention |
| 6-4 | II-6 | $NH_4^+$ | 1 | 12.15 | Mannit (5.0) | 2.9 | 2.9 | 21 | Invention |
| 6-5 | II-6 | $NH_4^+$ | 0 | 3.30 | Mannit (5.0) | 2.3 | 2.7 | 22 | Invention |
| 6-6 | II-3 | $NH_4^+$ | 2 | 3.42 | Mannit (5.0) | 1.4 | 1.7 | 47 | Invention |
| 6-7 | II-10 | $NH_4^+$ | 1 | 3.22 | Mannit (5.0) | 1.5 | 1.6 | 42 | Invention |

TABLE 7

| Sample No. | Exemplified Compound | Counter Cation | Molar Number of Water | Decreasing ratio in weight after drying at 50° C. | Additive-1 (wt %) | Rate of Expansion after Storage | Remarks |
|---|---|---|---|---|---|---|---|
| 7-1 | II-6 | $NH_4^+$ | 1 | 0.05 | Mannit (5.0) | Good | Invention |
| 7-2 | II-6 | $NH_4^+$ | 1 | 3.20 | Mannit (5.0) | Excellent | Invention |
| 7-3 | II-6 | $NH_4^+$ | 1 | 9.62 | Mannit (5.0) | Good | Invention |
| 7-4 | II-6 | $NH_4^+$ | 1 | 12.15 | Mannit (5.0) | Fair | Invention |
| 7-5 | II-6 | $NH_4^+$ | 0 | 3.30 | Mannit (5.0) | Excellent | Invention |
| 7-6 | I-3 | $NH_4^+$ | 2 | 3.42 | Mannit (5.0) | Excellent | Invention |
| 7-7 | I-10 | $NH_4^+$ | 1 | 3.22 | Mannit (5.0) | Excellent | Invention |

As is obvious from Table 7, it is understood that the effects of the present invention become distinguished in the case where the tabular shaped composition comprises a ferric complex of aminopolycarboxylic acid hydrate and a decreasing ratio in weight of photographic processing composition after drying at 50° C. is within the range of 0.1% to 10.0% by weight.

Experiment 12

As to the mixtures prepared in Example 9, the same experiments as in Example 11 were carried out, to obtain similar results as obtained in Example 11.

What is claimed is:

1. A solid composition for processing a silver halide photographic light-sensitive material comprising a granulated particle containing a ferric complex of an amino polycarboxylic acid and a sugar alcohol.

2. The solid composition of claim 1 wherein said composition contains said sugar alcohol in an amount from 0.5% to 30% by weight.

3. The solid composition of claim 1, wherein said composition comprises a ferric complex hydrate and a decreasing ratio in weight of said solid composition after drying at 50 ° C. is within a range of 0.1% to 10.0% by weight.

4. The solid composition of claim 2, wherein said composition comprises a ferric complex hydrate and a decreasing ratio in weight of said solid composition after drying at 50° C. is within a range of 0.1% to 10.0% by weight.

5. The solid composition of claim 1, wherein said aminopolycarboxylic acid is represented by Formula I:

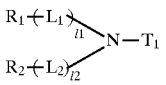

Formula I wherein $T_1$ represents a hydrogen atom, a hydroxyl group, a carboxyl group, a sulfo group, a carbamoyl group, a phosphono group, a phosphonic group, a sulfamoyl group, an alkyl group, an alkoxyl group, an alkylsulfonamido group, an alkylthio group, an acylamino group, a hydroxamic acid, a hydroxyalkyl group or

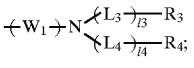

wherein $W_1$ represents an alkylene group, an arylene group, an alkenylene group, a cycloalkylene group, an aralkylene group or

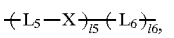

wherein X represents —O—, —S—, a divalent heterocyclic group or

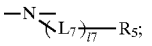

wherein $R_1$ through $R_5$ independently represent a hydrogen atom, a hydroxyl group, a carboxyl group, a sulfo group, a carbamoyl group, a phosphono group, a phosphonic group, a sulfamoyl group, a sulfonamido group, an acylamino group or a hydroxamic group, provided that at least one of $R_1$ through $R_5$ is a carboxyl group; $L_1$ through $L_7$ independently represent a group selected from the group consisting of an alkylene group, an arylene group, an alkenylene group, a cycloalkylene group and an aralkylene group; $l_1$ trough $l_7$ independently represent an integer of zero to six, provided that $l_{15}$ through $l_6$ are not zero simultaneously.

6. A solid composition for processing a silver halide photographic light-sensitive material comprising a granulated particle containing a ferric complex of an amino polycarboxylic acid and a sugar alcohol, said granulated particle being the product of the process of (1) mixing said ferric complex of said amino polycarboxylic acid and said sugar alcohol, to form a mixed composition, and thereafter (2) granulating said mixed composition of said ferric complex and said sugar alcohol.

7. The solid composition of claim 6 wherein said solid composition is a tablet produced by compressing said granulated particle.

8. The solid composition of claim 1 wherein said solid composition is a tablet produced by compressing said granulated particle.

* * * * *